United States Patent [19]

Wentworth, Jr.

[11] 4,410,467

[45] Oct. 18, 1983

[54] ION-VAPOR GENERATOR AND METHOD

[76] Inventor: Fred A. Wentworth, Jr., R.F.D. 2, Brentwood Rd., Exeter, N.H. 03833

[21] Appl. No.: 319,203

[22] Filed: Nov. 9, 1981

[51] Int. Cl.[3] ..... B01F 3/04

[52] U.S. Cl. ..... 261/18 A; 431/4; 123/52 R; 261/55; 261/DIG. 80; 261/121 R

[58] Field of Search ..... 261/18 A, 55, DIG.80, 261/121 R; 431/4; 123/25 R

[56] References Cited

U.S. PATENT DOCUMENTS

| | | | |
|---|---|---|---|
| 1,814,370 | 7/1931 | Davis | 123/25 R |
| 2,715,392 | 8/1955 | Grevas | 261/18 A |
| 3,537,434 | 11/1970 | Herpin | 261/18 A |
| 3,862,819 | 1/1975 | Wentworth, Jr. | 261/18 A |
| 4,016,837 | 4/1977 | Wentworth, Jr. | 261/18 A |
| 4,090,838 | 5/1978 | Schena et al. | 261/18 A |
| 4,133,628 | 1/1979 | Morrison | 261/18 A |
| 4,152,374 | 5/1979 | Wenger et al. | 431/4 |
| 4,173,450 | 11/1979 | Schrank | 261/18 A |
| 4,279,223 | 7/1981 | Csonka et al. | 261/18 A |
| 4,325,691 | 4/1982 | Evans et al. | 431/4 |

FOREIGN PATENT DOCUMENTS

| | | | |
|---|---|---|---|
| 2722431 | 3/1978 | Fed. Rep. of Germany | 261/18 A |

*Primary Examiner*—Tim R. Miles

*Attorney, Agent, or Firm*—Thomas N. Tarrant

[57] ABSTRACT

Apparatus of the invention bubbles air through a dielectric liquid including water to produce a vapor for catalytic enhancement of combustion. By maintaining low turbulence and tailoring the bubble rate to the demand of a connected combustion device, a substantial amount of negative ionization is produced contributing greatly to the catalytic action and the efficiency of a connected combustion device such as a heating furnace.

5 Claims, 1 Drawing Figure

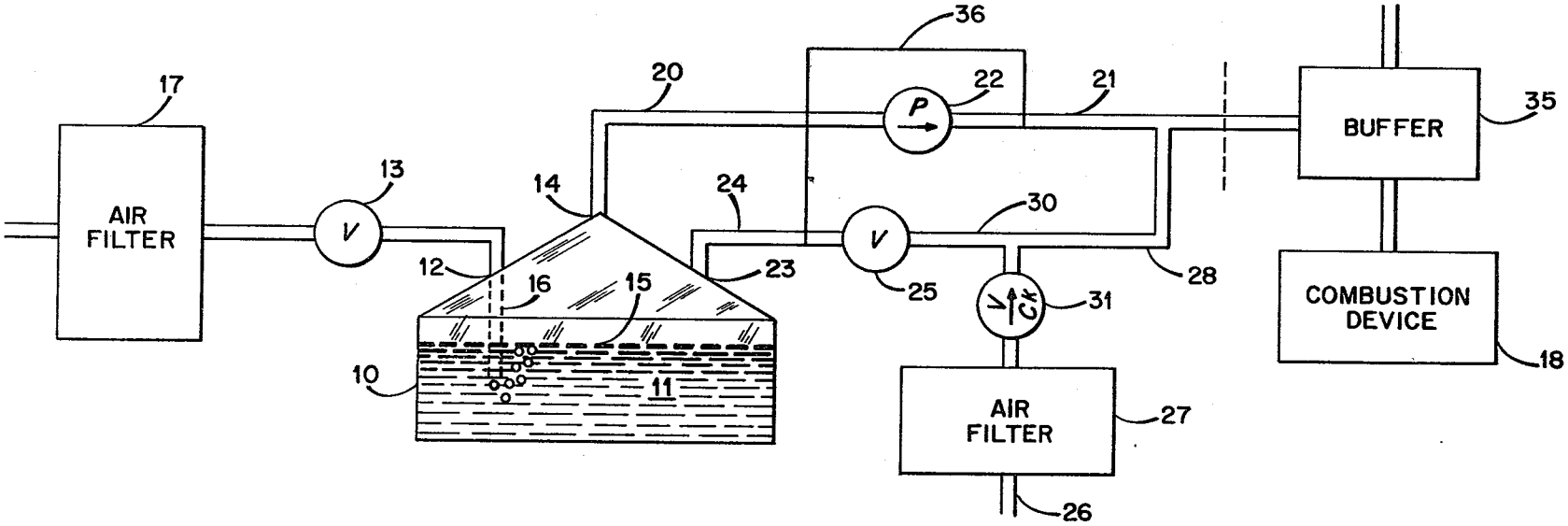
BUFFER
COMBUSTION DEVICE
AIR FILTER
AIR FILTER
P
V
V
35
18
28
27
21
31
26
30
36
22
25
23
24
20
11
15
14
16
12
13
10
17

ION-VAPOR GENERATOR AND METHOD

BACKGROUND OF THE INVENTION

1. Field of the Invention:

The present invention relates to vapor catalyst generators for combustion enhancement and particularly to such generators which bubble gas through liquid to provide the vapor.

2. Description of the Prior Art:

The presence of small amounts of water is known to have a catalytic effect on combustion as described in Van Nostrand's Scientific Encyclopedia, fourth edition, at page 1501. For many years, bubbling vapor generators have been used effectively on internal combustion engines. In the last ten years significant improvements have been made in bubbling vapor generators for heating apparatus as well as for internal combustion engines. Examples are found in applicant's U.S. Pat. Nos. 3,862,819 and 4,016,837. The exact mechanisms by which water enhanced combustion has never been fully understood nor is it now. Combustion is an extremely complex chemical process. A further puzzle has been that the bubbling process of vapor generation has usually produced better results than other methods for hitherto unknown reasons.

SUMMARY OF THE INVENTION

For a better understanding of the enhancement mechanisms involved, applicant and his licensees employed research scientists to investigate. While the investigations did not provide a full answer to the catalytic mechanisms of water, they did discover that bubble-type vapor generators tended to generate negative ions. They also discovered that the negative ions correlated with the amount of enhancement achieved. The problem then was to discover how to both maximize and stabilize the generation of negative ions in the vapor apparatus. Thus the invention lies both in the apparatus and the method of operating the apparatus to generate the ion-rich vapor. The apparatus uses a bubbling container containing a dielectric liquid including water. A gas inlet extends below the liquid level in the container while a gas outlet commences above the liquid level. A second gas inlet above the liquid level together with constictions at the first gas inlet control bubble rate and total gas flow through the apparatus. Pressure producing means is connected to provide a pressure differential between the first gas inlet and the gas outlet so as to cause bubbling. The method of operating requires that the normal air intake of the combustion device, at a connection point to which the present generator is to be attached, be measured. The output of the generator is then adjusted by input and recycle adjustments to match the measured quantity. In making these adjustments, the bubble rate is simultaneously adjusted to pass 5000 cubic centimeters plus or minus 20% per hour per 100,000 BTUs of fuel consumption per hour. An electrometer connected in the output path of the generator adjacent the combustion device may be used for further adjustments to obtain maximum negative voltage readings.

BRIEF DESCRIPTION OF THE DRAWING

The FIGURE is a diagramatic illustration of the inventive ion-vapor generator partially in block form.

DESCRIPTION OF THE PREFERRED EMBODIMENT

The generator of the invention bubbles gas, usually ambient air, through liquid 11 in container 10. Container 10 may be molded from plastic material such as polyvinylchloride. Container 10 is partially filled with liquid 11 which is a dielectric liquid containing water. Liquid 11 may be deionized or distilled water. Various additives have been used for lowering the freezing temperature or improving catalytic effect. A nonmiscible supernatant layer of a dieclectric liquid having a low or negligible evaporation rate has been used as a control layer to reduce turbulent splashing and control the rate at which water is exhausted from container 10. Supernatant liquids used have been selected for minimal foaming and some of the commercial synthetic oils have been found suitable. Neither the supernatant layer nor its specific composition are critical to the invention and the layer is not depicted in the drawing. Salts, alkalines or acids in liquid 11 reduce ion generation due, apparently, to availability of excessive mobile charges.

Neither the size of container 10 nor the depth of liquid 11 are critical. Container 10 has at least one gas inlet 12 and at least one gas outlet 14. Gas inlet 12 may be connected to container 10 either above or below liquid surface 15. If inlet 12 is connected above surface 15 as depicted in the FIGURE, conduit 16 must be connected to inlet 12 inside container 10 and extend below surface 15 so as to provide bubbling. Inlet 12 is connected outside container 10 to a suitable gas source, preferably just ambient air.

When inlet 12 is cennected to ambient air, it is preferred to conect air filter 17 to inlet 12, particularly in highly contaminated atmospheres. A filter that filter out particles having a dimension greater than 90 microns has been found to work well. If the filter is much coarser, in contaminated atmospheres, liquid 11 eventually loses it required dielectric property and must be replaced. If filter 17 is much finer, the production of negative ions has usually been reduced. Whether this has been due to some characteristics of the filter or whether some small particles in normal ambient air improve operation, is not known.

Valve 13 is connected in the line to gas inlet 12 either before or after filter 17 to provide an adjustable constriction as part of the bubble rate control.

A source of pressure to produce bubbling may be connected at inlet 12. However the preferred method of connecting a pressure source is at outlet 14 for reasons that will be explained below.

Outlet 14 is connected to container 10 above surface 15 and is connected to combustion device 18 by conduits 20 and 21. In the preferred embodiment, as depicted in the drawing, a source of pressure such as pump 22 is connected in conduits 20 and 21. Thus conduit 20 connects outlet 14 to the intake side of pump 22 while conduit 21 connects the output side of pump 22 to combustion device 18.

Second gas inlet 23 connected to container 10 above surface 15 is used to provide control of the gas flow volume out through conduit 21 to device 18. Inlet 23 is connected via conduit 24 and valve 25 to a gas source such as ambient air at air intake 26. Air filter 27, similar to air filter 17, may be used at intake 26. Since inlet gas provided at inlet 23 bypasses liquid 11, it reduces the amount of gas passed through liquid 11 from inlet 12 thus interacting with the bubble rate.

Preferably, the amount of gas passed through conduit 21 to device 18 is controlled by a feedback or recirculation conduit 28 connected from conduit 21 to a tee connection 30 connecting valve 25, intake 26 and conduit 28 together. In this arrangement, a further valve 31 is connected between intake 26 and tee 30. While valve 31 may be an adjustable valve, a fixed unilateral valve allowing intake only has been found preferable. Valve 31 is used to restrict outflow from the pressure side of pump 22 through intake 26. While normally there would be a net suction at intake 26, this can change with variations in operating conditions and use of a unilateral valve 31 compensates for many of the variations.

The connection of conduit 21 to combustion device 18 can be made in a number of ways. When device 18 has a blower or compressor for intake of combustion air, conduit 21 can connect to the intake of such blower or compressor. Conduit 21 can also be connected by tube to a low pressure point adjacent the combustion zone of device 18. Such a low pressure point is defined as a point near the combustion flame where air at ambient atmospheric pressure will be drawn into the flame.

In combustion devices having greatly different firing rates between which they will be switched from time to time, it is preferable to connect conduit 21 to device 18 through buffer 35. A suitable buffer 35 is a chamber having an inlet connection to conduit 21, an inlet from ambient atmosphere and an outlet to device 18. The purpose of buffer 35 is to reduce turbulence in the ion-vapor generator that would otherwise be caused by substantial increases in suction from device 18.

It will be understood that an ion generator in accordance with the present invention is quite sensitive to a number of conditions. For example, if the ambient air carries a net positive charge as might be caused by ionization from nearby electric motors, either air brought in must be from a remote location or the charge must first be neutralized. Electrically conductive components in the generator itself, must normally be insulated from ground to prevent neutralization of the negative ion buildup. High velocities and other causes of turbulence have been found detrimental to negative ion buildup also. Thus the path from outlet 14 to combustion device 18 is preferably free of valves or similar constricting devices and is preferably less than two meters in length. A preferred configuration of pump 22 is a bellows-type pump rather than a rotating blade. Rotating blades produce undesirable turbulence at the blade edges.

Conduit sizes and orifices are selected for low velocities and slow bubble rates at the flow demand of the particular system. A further sensitivity that has been encountered is apparently due to electrical fields built up between different parts of the generator. To avoid this, it is preferable to use conduit having a low electrical impedance path and briding electrical insulating components separating lengths of conduit. Suitable conduit is plastic tubing containing a carbon strip molded into the plastic. This has been found particularly desirable for conduits 20, 21, 24 and 28. Wire 36 connects conduits 20, 21 and 24 as depicted in the drawing. Wire 36 is electrical wire and can be connected to conduits 20, 21 and 24 by stainless steel hoseclamps or other means for pressing firmly in to the carbon strips. Further wire connections are preferable used wherever the low impedance path is interrupted by plastic tees, couplings, valves or the like.

An exemplary embodiment of the invention actually used on a commercial furnace is given in the following example.

EXAMPLE

Combustion device 18 was a steam furnace burning No. 2 fuel oil at a 114 liters per hour rate.

Container 10 had a volume capacity of 15 liters and was made of polyvinylchloride 5 mm thick.

Liquid 11—11.5 liters of distilled water.

Conduits 20, 21, and 24 were plastic tubing sold under the trademark TYGON and having an ID of 10 mm, an OD of 13 mm and containing a carbon conductive strip along its length.

Air filter 17 was a 90 micron filter.

Pump 22 was a rubber-bellows type pump made entirely of plastic and rubber and having a flow capacity of 28,300 ccm per hour.

Connections to inlet 23 were as shown in the drawing but with valve 31 an adjustable bilateral valve.

Wire 36—Copper electrical wire connected by hoseclamps to conduits 20 and 21 only.

Connection to device 18 was by connecting conduit 21 to the combustion blower intake.

OPERATION

Air flow was measured at the connection point to the blower using a short length of the same tubing used for conduit 21. The flow measured 142 cdm (cubic decimeters) per hour. The ion-vapor generator was then adjusted without connection to provide an output gas flow at conduit 21 of approximately 142 cdm per hour.

The ion-vapor generator was also adjusted at valve 13 to pass air through liquid 11 at a rate equal to approximately 5 cdm per 100,000 BTUs. At a firing rate of 114 liters per hour, this came to 150 cdm per hour. The actual adjustment was made to a rate of approximately 140 cdm per hour in order to keep it less than the total output at conduit 21. This is well within the 20% tolerance allowed. Due to interaction, valves 13 and 25 have to be adjusted together to obtain the right flows. Next conduit 21 was connected to the combustion blower by a tee connection to the short length of tubing previously mentioned. The tee was an adaptor in which the probe of a Keithley model 610C electrometer was placed. With the furnace and ion-vapor generator both operating, valves 13 and 25 were given minor readjustments to read maximum negative voltage on the electrometer. The results were an average 13% saving in fuel and a reduction in emissions.

The method of operation of the invention is substantially as described in the foregoing example. The variations introduced by maximizing the electrometer readings fall generally within plus or minus 20% of the preferred flow rates given. It has to be remembered that the size and location of the connection to the combustion device has to be such that the air drawn in without the generator connected should be at least 5 cdm per 100,000 BTUs of fuel to be consumed per hour.

While the invention has been described in relation to a specific embodiment, many variations will be obvious to those skilled in the art and the invention is contemplated for use with many different varieties of combustion devices other than furnaces. Accordingly it is intended to cover the various modifications and variations that fall within the full scope of the following claims.

I claim:

1. A generator for vapor carrying a net surplus of electrically negative ions comprising:

(a) a container (10) partially filled with a dielectric liquid (11) including water;

(b) a first gas inlet connection (12) to below the liquid level (15) in said container (10);

(c) an outlet connection (14) from above the liquid level (15) in said container (10) for the outlet of gas;

(d) a pump (22) having an inlet and an outlet, said inlet being connected to said outlet connection (14);

(e) a first conduit (21) connected to said outlet;

(f) a recirculating conduit (24,28) connected to said first conduit (21) and to a point (23) preceding said pump (22) and following the liquid level (15) in the path of gas flow through the generator so as to provide a recirculating path around said pump (22);

(g) a second gas inlet connection (23) in the path of gas flow beyond said liquid level (15) for reducing gas flow through said liquid without changing gas flow through said outlet connection (14); and, (h) an exhaust termination (35) of said first conduit providing a vapor output.

2. A generator according to claim 1 wherein said point is said second gas inlet connection and said second gas inlet connection is additionally connected to ambient air through a unilateral intake valve.

3. A generator according to claim 1 wherein said recirculating conduit has a further inlet connection from ambient air and said further inlet connection comprises a unilateral inlet valve and wherein said recirculating conduit contains an adjustable valve between said point and said further inlet connection.

4. A method of providing ionized catalytic vapor to a combustion zone comprising:

(a) partially filling a closed container having at least one input connection and at least one output connection with a dielectric liquid including water;

(b) bubbling ambient air by means of a pump through said liquid from said input connection to said output connection at a rate of 5000 ccm plus or minus 20% per 100,000 BTUs of fuel consumption per hour in said zone;

(c) controlling said bubbling by providing an adjustable air path to the intake of said pump that bypasses said liquid;

(d) providing an input passage to said combustion zone at a point and in a way that normal ambient air consumption through said passage is at least as great as said rate;

(e) connecting said output connection to said input passage;

(f) measuring the potential of the catalytic vapor with an electrometer; and, (g) adjusting said airpath for maximum negative voltage.

5. A method of providing ionized catalytic vapor according to claim 4 further comprising filtering the air into said input connection to filter out particles having a dimension larger than substantially 90 microns.

* * * * *